US005363124A

United States Patent [19]

Arway

[11] Patent Number: 5,363,124

[45] Date of Patent: Nov. 8, 1994

[54] PRINTHEAD FOR INK JET PRINTERS

[75] Inventor: George Arway, Norridge, Ill.

[73] Assignee: Videojet Systems International, Inc., Wooddale, Ill.

[21] Appl. No.: 59,998

[22] Filed: May 10, 1993

Related U.S. Application Data

[63] Continuation-in-part of Ser. No. 9,586, Jan. 26, 1993, abandoned.

[51] Int. Cl.[5] ..... B41J 2/02

[52] U.S. Cl. ..... 347/74

[58] Field of Search ..... 346/75, 140 R

[56] References Cited

U.S. PATENT DOCUMENTS

| | | | |
|---|---|---|---|
| 3,916,421 | 10/1975 | Hertz | 346/75 |
| 4,219,823 | 8/1980 | Fathergill et al. | 346/75 |
| 4,520,367 | 5/1985 | Ishikawa et al. | 346/75 |
| 4,636,809 | 1/1987 | Eremity | 346/75 |
| 4,800,398 | 1/1989 | Naruse et al. | 346/75 |

OTHER PUBLICATIONS

"Static Electrical Charge Grounding In A Printer With Plastic Parts", IBM Technical Disclosure Bulletin, vol. 28, No. 7, Dec. 1985.

*Primary Examiner*—George H. Miller, Jr.
*Attorney, Agent, or Firm*—Rockey, Rifkin and Ryther

[57] ABSTRACT

The printhead of an ink jet printer includes an electrically conductive plastic chassis and charging electrode. The plastic chassis can be constructed of plastic resins such as polyester, nylon, acetal, and polyphenylene sulphide imbedded with electrically conductive fibers such as carbon and stainless steel. The fibers can be coated with nickel to improve the shielding characteristics of the material.

21 Claims, 4 Drawing Sheets

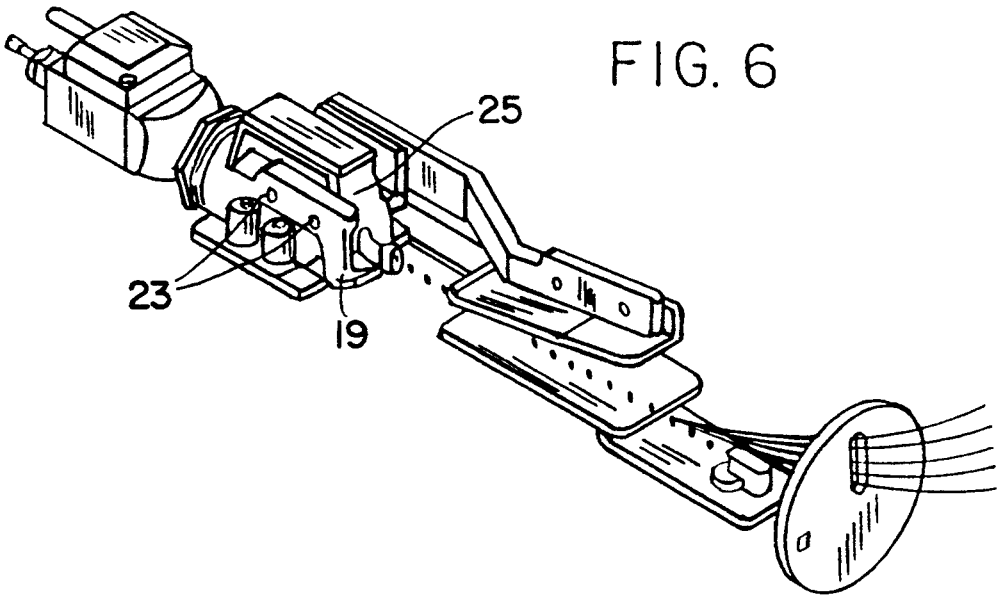
FIG. 6
FIG. 7
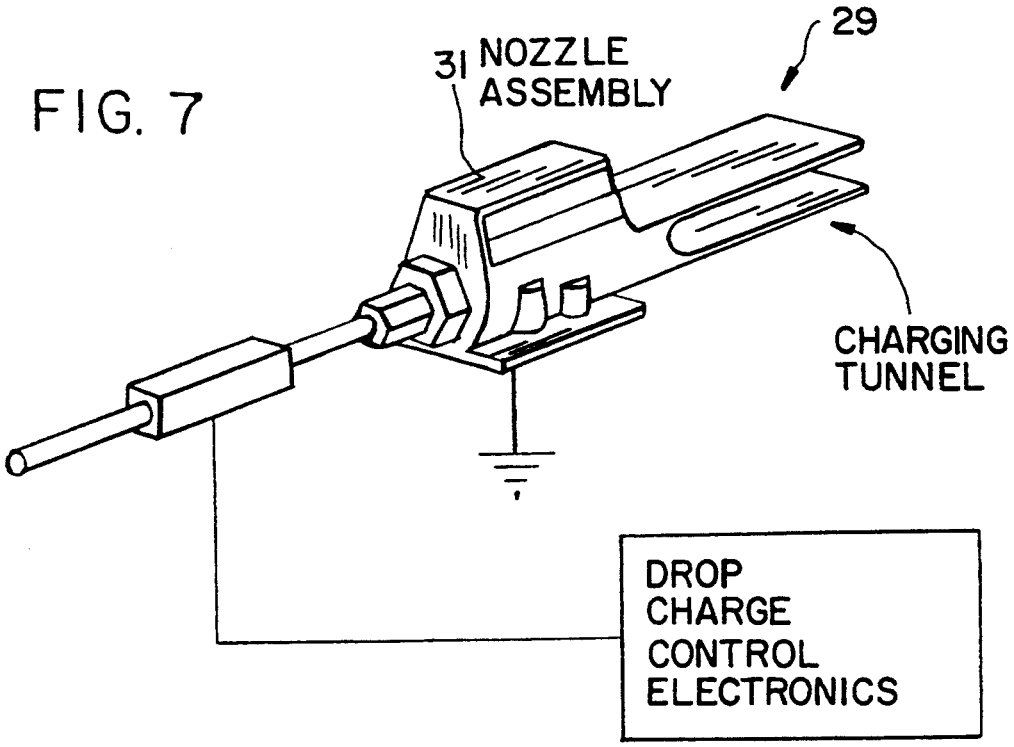

PRINTHEAD FOR INK JET PRINTERS

This application is a continuation-in-part of application Ser. No. 08/009,586, filed Jan. 26, 1993, now abandoned.

BACKGROUND OF THE INVENTION

The invention relates, generally, to ink jet printers and, more particularly, to an improved printhead for such printers.

A typical printhead, shown in FIG. 1, consists of an apparatus 2 for generating ink drops that are electrically charged by a charging electrode 4. The charging electrode must be dimensionally accurate, have sufficient electrical conductivity to charge a drop, be able to shield the ink stream from high voltage generated electrical fields and noise and must be corrosion resistant. The known prior art charging electrodes typically include a machined or formed metal electrodes consisting of machined metal plates or machined metal cylinders. The electrodes are typically fixed to an insulated member such as the housing, support arms, or printed circuit boards. The electrodes are fixed to the insulated member by a variety of fasteners such as screws, machined supports or soldering. Examples of such prior art charging electrodes are the Hitachi GXII-S and Videojet EXCEL, Domino Solo 5, Hueft Printer, Willett 3850 and Image Series 7. While such charging electrodes perform satisfactorily they are complex and costly to manufacture because of the number of parts and the materials involved. Moreover, because these electrodes are made from corrosion resistant metals they require expensive fabrication processes.

The charged drops are then selectively deflected by an electric deflection field created between plates 6 and 8 to create a desired printed image on a substrate. The drops that are not deflected onto the substrate are retrieved in an ink catcher 10 and recirculated.

These components are carried by a chassis 12 that is connected to a duct 14 carrying wires for the electrical signals and an ink supply line. A nozzle cover 11 and printhead cover 13 surround chassis 12 to protect the internal components. The chassis 12 is typically constructed of conductive metal in order to perform three separate functions. First, ink catcher 10 is connected to a phase sensing circuit that determines the proper amplifier phasing for the charging electrode. The sensing circuit is extremely sensitive and must be able to detect electrical currents on the order of nanoamps. Thus the sensing circuit must be shielded from electrical noise from the nozzle, charging tunnel and other components. The chassis, because it is electrically conductive, is grounded to provide such shielding.

Second, when the ink drops contact either the substrate or ink catcher, a microscopic charged fog is created due to ink spatter. Over time, this fog will build up on the printhead components to create errant electric fields which can misdirect the drops. By using a metal chassis and connecting it to ground, the charge from the fog is discharged and the errant electric fields are minimized.

Third, the chassis, because it is electrically conductive and connected to ground, can form a part of one of the deflection plates.

While a metal chassis performs these functions well, it is expensive to fabricate because of the relatively complex structure required. In an attempt to eliminate the use of the metal chassis, non-conductive plastic chassis have been developed. One such example of a plastic printhead chassis is the Willett 3800 which consists of a two-piece, hinged, insulating plastic chassis in which the nozzle, charge tunnel, charge sensor, ink catcher and high voltage deflection plates are mounted. The two-piece chassis is of a clam shell arrangement which forms an enclosure for these functional elements. The charge tunnel and one of the deflection plates are mounted to the pivoting portion of the chassis. The deflection plates are both mounted on insulating plastic blocks which, in turn, are mounted in the chassis. The charge tunnel consists of insulated parallel plates mounted to a metal fixture which is mounted to the plastic chassis. The structure is a monocoque with the two piece chassis serving as the outer cover.

The two piece chassis described above is mounted to the front of a metal box portion of the printhead which contains wiring connections. All wiring connections in the chassis are rigidly attached to their corresponding functional elements (i.e. the charge tunnel and deflection plates) and potted in place. No provision is made for ink mist discharge other than the wide spacing of the elements in the printhead. Moreover, the absence of a grounded cover renders this design susceptible to environmental electrical noise.

Another prior art plastic chassis is the Image Series 7 which consists of an elongated box having the nozzle, charging plates and deflection plates mounted to the outer surfaces thereof. Portions of these components extend through this surface into the interior of the box. All electrical connections to these components are made on the interior of the chassis by soldering shielded cables directly to the corresponding functional element. The plastic chassis is, in effect, an insulating mounting arm for the functional components. Noise sensitive connections are surrounded by separate metal cans to minimize noise interference. The front of the chassis is covered by a metal plate to help shield signals from external noise sources and to discharge externally accumulated ink mist. There is no provision, however, for discharging the ink mist on the internal surface of the chassis.

The use of the insulating plastic chassis of the prior art requires complex electrical connections and wiring details. Additionally, the discharge of the ink mist and noise protection can only be accomplished, if at all, by means of ancillary components. Finally, such printheads require two separate deflection plates because the insulated plastic chassis cannot be used for one of the plates.

Thus, an improved printhead chassis is desired that is less expensive than prior art chassis yet is capable of performing the functions of a metal chassis.

SUMMARY OF THE INVENTION

The printhead of the invention includes an electrically conductive plastic chassis that is simpler and less expensive to fabricate than a metal chassis yet performs like a metal chassis. Moreover, the charging electrode is also constructed of electrically conductive plastic material. The plastic chassis and charging electrode can be constructed of plastic resins such as polyester, nylon, acetal, and polyphenylene sulphide imbedded with electrically conductive fibers such as carbon and stainless steel. The fibers can be coated with nickel to improve the shielding characteristics of the material. An electrically conductive plastic charge electrode or tunnel is rendered sufficiently conductive to charge drops and provide electrical shielding when its total electrical resistance is of the order of 1,000 ohms or less across its length dimension.

BRIEF DESCRIPTION OF THE DRAWINGS

FIG. 6 shows the plastic charging electrode of the invention.

FIG. 7 shows an alternate embodiment of the charging electrode of the invention.

DETAILED DESCRIPTION OF THE INVENTION

Figure 1:
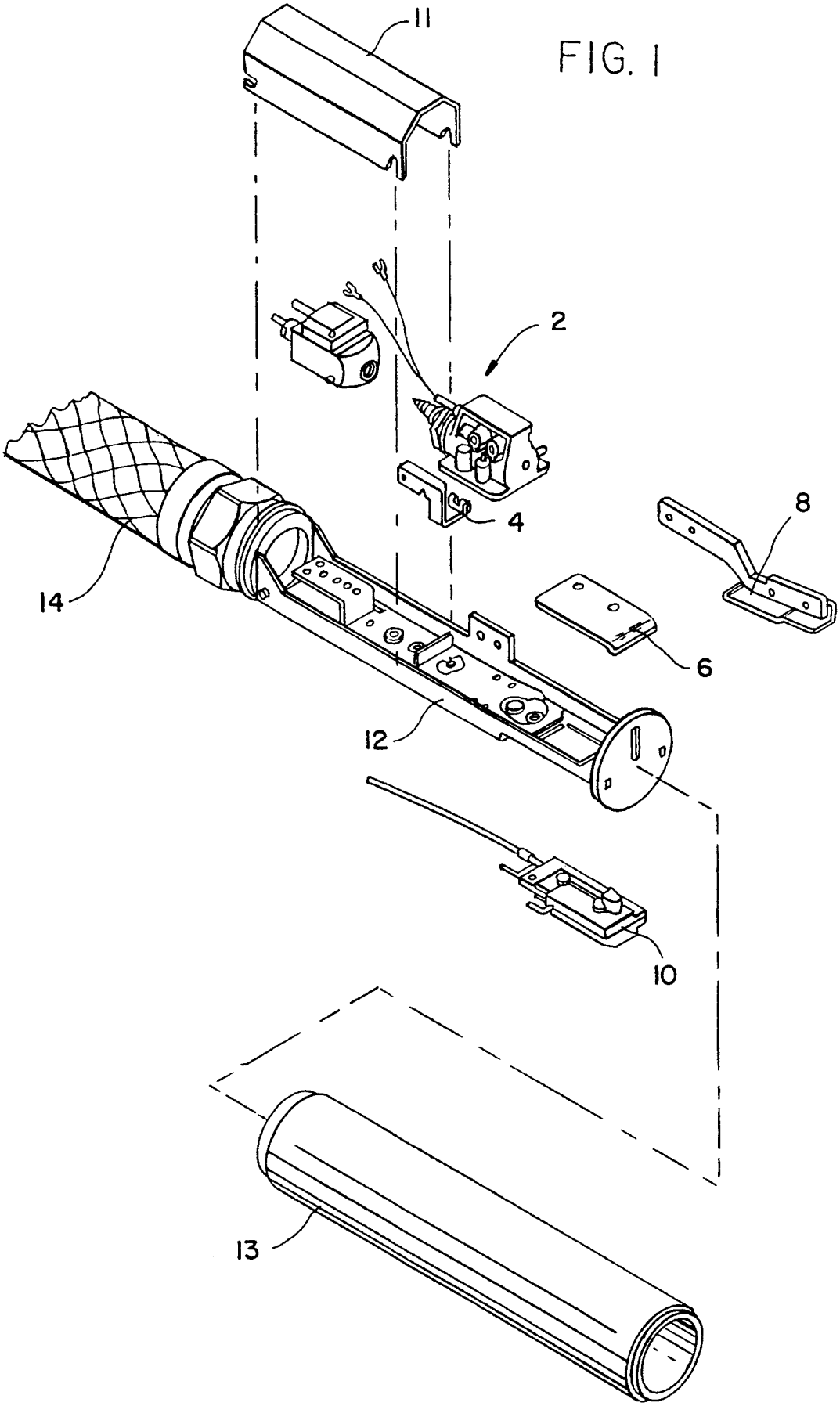
FIG. 1 shows a prior art printhead assembly.
Figure 2:
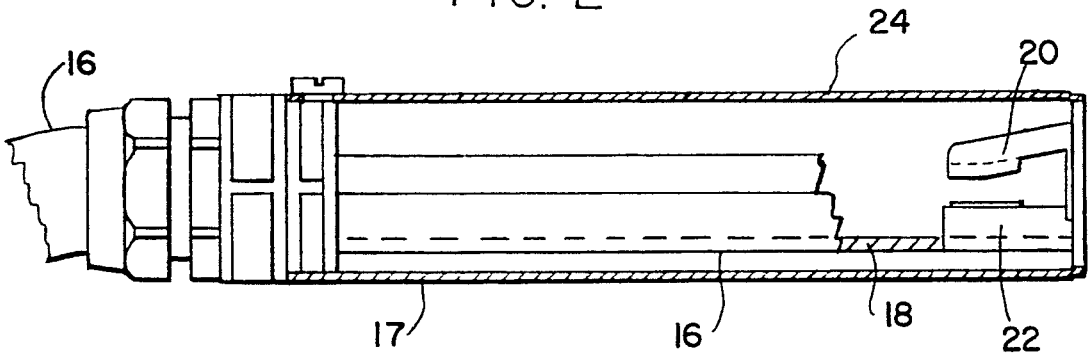
FIG. 2 shows a section view of the conductive plastic chassis of the invention.

Referring to FIG. 2, the printhead of the invention consists of a printhead duct or cord 16 connected to an electrically conductive plastic chassis 18. Chassis 18 carries the drop generator, ink catcher and related elements in a manner similar to that of the prior art.

Chassis 18 also carries the charging electrode 19 of the invention. As best shown in FIG. 6, the charging electrode 19 is attached by screws 23 to the nozzle housing 25 composed of electrically insulating material. The electrode 19 is formed of electrically conductive plastic which typically consists of an electrically nonconductive plastic resin in which are imbedded electrically conductive particulates or fibers. The plastic resins can include polyester, nylon, acetal and poly phenylene sulphide and the fibers or particulate can include carbon and stainless steel. Nickel coating the particulates or fiber enhances the electrical shielding characteristics of the material. Electrically conductive plastics are commercially available and can be obtained from a plastics material compounder that specializes in creating such compounds. As an alternative to the plastics with electrically conductive fibers, inherently conductive plastic resins such as polyacetylene can be used if desired.

An electrically conductive plastic charge electrode or tunnel is rendered sufficiently conductive to charge drops and provide electrical shielding when its total electrical resistance is of the order of 1,000 ohms or less across its length dimension. Stated otherwise, an electrically conductive plastic charge tunnel can be readily made from commercially available materials having surface resistivities below $10^5$ ohms per square. The charge tunnel preferably has an electrical resistance of approximately 100 ohms across its length.

The use of electrically conductive plastic allows the charging electrode to be molded resulting in a charging electrode having the desired characteristics that is much less expensive to manufacturer than the prior art devices while providing closer manufacturing tolerances and greater repeatability.

An alternate embodiment of the charging electrode is shown in FIG. 7 and includes a charging electrode 29 that is molded integrally with the nozzle housing 31 in a single electrically grounded part. Negative polarity drop charge voltages are applied to the ink stream via the nozzle ink inlet as taught by U.S. Pat. No. 4,139,251. Manufacturing the nozzle and charging electrode as a single part yields even greater manufacturing cost benefits by eliminating the need to assemble multiple parts.

Chassis 18 also forms the grounded deflection plate 20 and supports the high voltage deflection plate 22 as will hereinafter be described. The chassis is covered by a print head cover 24 to protect the printhead components.

Figure 3:
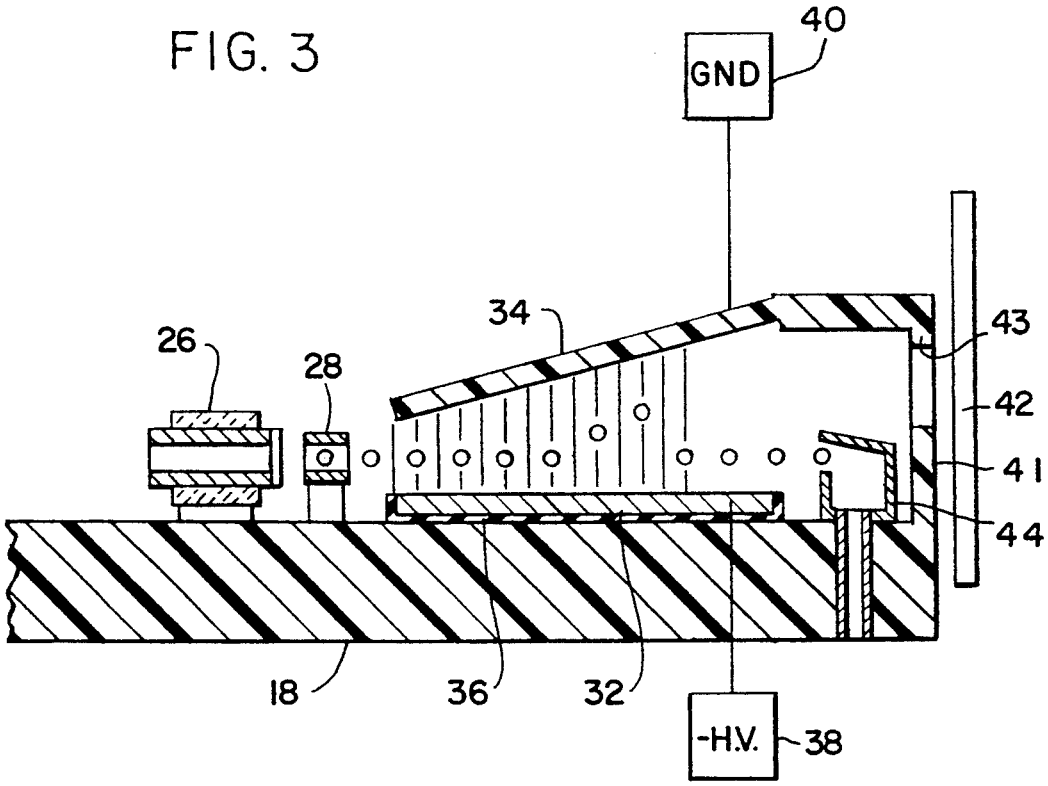
FIGS. 3, 4 and 5 show schematic views of alternate embodiments of the chassis of the invention in a printhead assembly.

The plastic chassis also consists of a thermoplastic or thermoset resin that can be molded to the desired configuration as previously described. Referring to FIG. 3, the printhead of the invention consists of the electrically conductive plastic chassis 18 supporting an ink jet nozzle 26. The charging electrode 28 charges the ink drops as they leave nozzle 26. In the illustrated embodiment a negative charge is applied to the drops whereby they are deflected onto the substrate by the electric deflection field created between lower electrode 32 and upper electrode 34. Specifically, lower electrode 32 is electrically insulated from the chassis 18 by insulating material 36 and is connected to negative high voltage source 38. Upper electrode 34 is formed as an integral molded extension of chassis 18 and is grounded at 40. The vertical leg 41 that connects chassis 18 to electrode 34 includes a slot 43 that allows the charged drops to reach substrate 42. Thus, charged drops are deposited on substrate 42 while uncharged drops which are not deflected are stopped by ink catcher 44. It should be noted that other suitable structures and combinations of drop charge polarity and deflection plate polarity can be used if desired.

Figure 4:
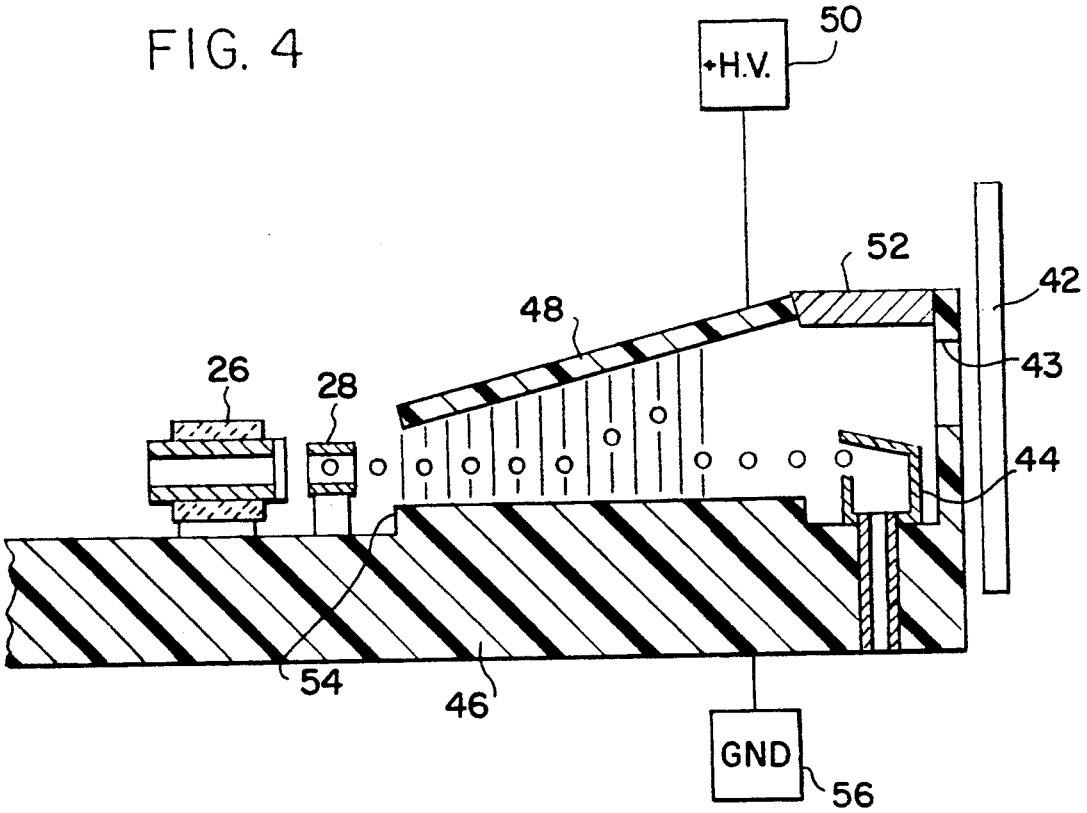

FIG. 4 shows a modification of the printhead of FIG. 3 and consists of an electrically conductive plastic chassis 46 supporting the nozzle assembly 26, charging electrode 28 and ink catcher 44 as previously described. Unlike the embodiment of FIG. 3 however, the upper deflection plate 48 is connected to a positive high voltage source 50 and is separated from chassis 46 by an insulating member 52. The lower deflection plate 54 is formed integrally with chassis 46 and is connected to ground 56.

Figure 5:
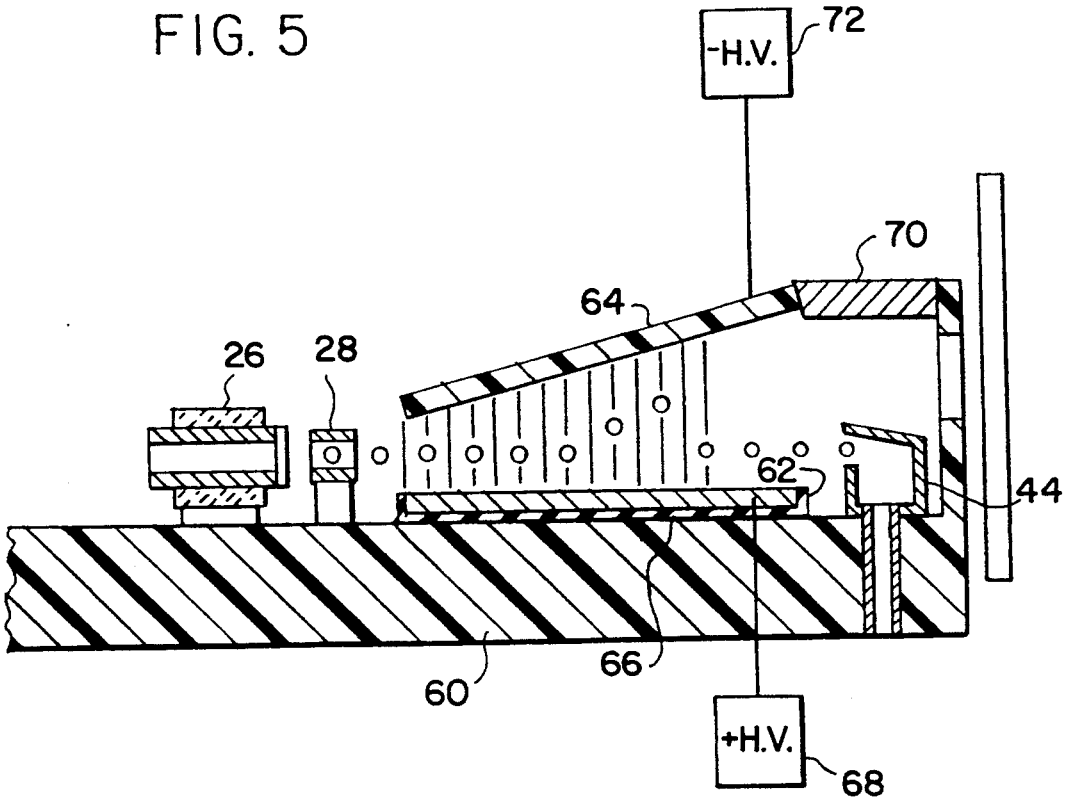

Referring more particularly to FIG. 5, a further modification of the printhead of FIG. 3 is shown and consists of an electrically conductive chassis 60 supporting the nozzle assembly 26, charging electrode 28 and ink catcher 44 as previously described. Unlike the previous embodiment, neither of the deflection plates 62 or 64 are formed integrally with the chassis 60. Deflection plate 62 is connected to chassis 60 by insulating member 66 and is connected to positive high voltage source 68. Deflection plate 64 is connected to chassis 60 by insulating member 70 and is connected to negative high voltage source 72.

The electrically conductive plastic chassis of the invention performs the same functions as the metal chassis of the prior art at a much lower fabrication cost without the need for the auxiliary elements or complex electrical connections used on the prior art nonconductive plastic chassis. In addition at least one of the high voltage electrodes can be fabricated as part of the chassis, if desired, adding a simplification and cost reduction not available with a metal chassis. The printhead using the chassis of the invention combines the functional superiority of a metal chassis with the low manufacturing cost of a molded insulating plastic chassis.

It will be appreciated that the printhead of the invention can be used in applications in which a plurality of nozzles or a plurality of printheads are used in combination, if desired. While the invention has been described in some detail with respect to the figure, it is to be understood that numerous changes in the construction and operation of the device can be made without departing from the spirit and scope of the invention.

What is claimed is:

1. A printhead assembly for an ink jet printer, comprising:

(a) a chassis constructed of electrically conductive plastic;

(b) said chassis supporting an ink jet nozzle, a charging electrode, and a pair of spaced apart deflection plates; and means for electrically grounding said chassis, said grounded chassis being sufficiently conductive to (i) discharge ink mist in the proximity of said deflection plates; and (ii) shield the electric deflection field generated by said deflection plates from electrical noise to insure accurate drop placement.

2. The printhead according to claim 1, wherein one of said deflector plates is integrally formed with said chassis.

3. The printhead according to claim 2, wherein said one of said deflection plates is connected to ground.

4. The printhead according to claim 1, wherein said chassis is formed of a plastic resin imbedded with conductive fibers.

5. The printhead according to claim 4, wherein said resin is nylon.

6. The printhead according to claim 4, wherein said resin is polyester.

7. The printhead according to claim 4, wherein said resin is acetal.

8. The printhead according to claim 4, wherein said resin is polyphenylene sulphide.

9. The printhead according to claim 4, wherein the conductive fibers are carbon.

10. The printhead according to claim 4, wherein the conductive fibers are stainless steel.

11. A chassis for an ink jet printhead assembly comprising:

a first portion being constructed of electrically conductive plastic and supporting an ink jet nozzle and charging electrode and first and second deflection plates, said first deflection plate also being formed of electrically conductive plastic and integrally formed with said first portion and being grounded.

12. A printhead assembly for an ink jet printer, comprising:

a) an electrically conductive chassis supporting an ink jet nozzle and a pair of spaced apart deflection plates;

b) a charging electrode constructed of electrically conductive plastic; and c) means for electrically grounding said chassis.

13. The printhead according to claim 12, wherein said charging electrode is formed of a plastic resin imbedded with conductive fibers.

14. The printhead according to claim 13, wherein said resin is selected from the group consisting of: nylon, polyester, acetal and polyphenylene sulphide.

15. The printhead according to claim 13, wherein the conductive fibers are carbon.

16. The printhead according to claim 13, wherein the conductive fibers are stainless steel.

17. The printhead according to claim 12, wherein the charging electrode has a resistance of 1000 ohms or less across its length dimension.

18. The printhead according to claim 17, wherein the resistance is approximately 100 ohms across its length dimension.

19. The printhead according to claim 12, wherein the charging electrode is formed from materials having surface resistivities below $10^5$ ohms per square.

20. A printhead assembly for an ink jet printer, comprising:

a chassis constructed of electrically conductive plastic;

said chassis supporting an ink jet nozzle, a charging electrode, and a pair of spaced apart deflection plates, said charging electrode being formed of electrically conductive plastic; and means for electrically grounding said chassis, said grounded chassis being sufficiently conductive to (i) discharge ink mist in the proximity of said deflection plates; and (ii) shield the electric deflection field generated by said deflection plates from electrical noise to insure accurate drop placement.

21. The printhead according to claim 20, wherein said ink jet nozzle and said charging electrode are formed integrally of electrically conductive plastic.

* * * * *